US006538383B1

(12) United States Patent
Takeuchi

(10) Patent No.: US 6,538,383 B1
(45) Date of Patent: Mar. 25, 2003

(54) HIGH-PRESSURE MERCURY LAMP

(75) Inventor: Nobuyoshi Takeuchi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/416,463

(22) Filed: Oct. 12, 1999

(30) Foreign Application Priority Data

Oct. 13, 1998 (JP) ..... 10-290327

(51) Int. Cl.[7] ..... H01J 61/34

(52) U.S. Cl. ..... 313/637; 313/110; 313/635; 313/492

(58) Field of Search ..... 313/637, 110, 313/111, 112, 113, 641, 620; 315/350, 351

(56) References Cited

U.S. PATENT DOCUMENTS

| | | | | |
|---|---|---|---|---|
| 4,156,826 A | * | 5/1979 | Hernqvist | 313/221 |
| 4,988,918 A | * | 1/1991 | Mori et al. | 313/641 |
| 5,059,865 A | | 10/1991 | Bergman et al. | |
| 5,109,181 A | | 4/1992 | Fischer et al. | |
| 5,491,525 A | | 2/1996 | Yamasaki et al. | |
| 5,497,049 A | | 3/1996 | Fischer | |
| 5,650,630 A | | 7/1997 | Dierks et al. | |
| 5,864,388 A | * | 1/1999 | Shima et al. | 355/53 |
| 5,952,768 A | * | 9/1999 | Strok et al. | 313/110 |
| 6,271,628 B1 | | 8/2001 | Sugitani et al. | |

FOREIGN PATENT DOCUMENTS

| | | |
|---|---|---|
| EP | 917180 | 5/1999 |
| EP | 944109 | 9/1999 |
| EP | 949658 | 10/1999 |
| JP | 2148561 | 6/1990 |
| JP | 6-305768 | 11/1994 |
| JP | 9-165641 | 6/1997 |
| JP | 11-297268 | 10/1999 |

* cited by examiner

*Primary Examiner*—Vip Patel
*Assistant Examiner*—Ken A Berck

(57) ABSTRACT

A high-pressure mercury lamp includes an arc tube, and a pair of electrodes is provided in a discharge space of the arc tube. In the discharge space, mercury and xenon gas are sealed. The amount of mercury per unit volume that is to be sealed in the discharge space is within a range of 0.12 $mg/mm^3$ to 0.35 $mg/mm^3$. A pressure of the xenon gas in the discharge space is within a range of $2.0\times10^5$ Pa to $2.0\times10^6$ Pa.

11 Claims, 5 Drawing Sheets

HIGH-PRESSURE MERCURY LAMP

BACKGROUND OF THE INVENTION (1) Field of the Invention

The present invention relates to a high-intensity discharge lamp and high-pressure mercury lamp that are used in general lighting fixtures and optical instruments, and also relates to an illumination device using the high-pressure mercury lamp and an image display apparatus using the illumination device.

(2) Description of Prior Art

Conventionally, in an illumination device used in an image display apparatus such as a liquid crystal projector, a light source and a concave reflecting mirror are usually formed in one piece. As the light source, a high-pressure mercury lamp with a short arc, which is close to a point light source, has been used. The high-pressure mercury lamp has advantages, such as an excellent luminous efficiency, high intensity, favorable balance of red, blue, and green in emitted light, and long lifetime.

Such a high-pressure mercury lamp is provided with a glass tube with sealing parts set at its both ends, the glass tube including a pair of electrodes. Inside a discharge space of the glass tube, mercury used as light-emitting material and argon gas for starting-up are sealed under a predetermined pressure.

Using this conventional high-pressure mercury lamp, however, there has been a problem that it takes a long time for light flux to attain 90% of its stable state after the lamp is started up (this period of time is referred to as the "light buildup time" hereinafter). This is because only mercury is sealed as the light-emitting material.

This problem is explained more specifically as follows. In the high-pressure mercury lamp, a temperature of the central point of arc discharge increases to about 6,000 K or higher after the lamp is started up. At this high temperature, atoms of mercury are excited to emit lights. Mercury is in a liquid state at room temperature, and so it takes long for mercury to be vaporized as the temperature of the inner wall surface of the glass tube increases through discharge. This unavoidably leads to a longer light buildup time.

Especially in the case of a high power lamp that is relatively large in the shape of a glass tube, the light buildup time would be very long, such as approximately 5 to 10 minutes.

Although the conventional high-pressure mercury lamp provides high intensity, it has a problem about the light buildup time as described above. In particular, when the high-pressure mercury lamp is used in an image display apparatus, such as a liquid crystal projector, it takes too long before images are displayed.

It should be noted here that the stated problem associated with the light buildup time generally occurs to high-intensity discharge lamps that use material aside from mercury as the light-emitting material.

SUMMARY OF THE INVENTION

It is therefore an object of the present invention to provide a high-intensity discharge lamp and a high-pressure mercury lamp that each have an improved light buildup time.

The object of the present invention can be achieved by a high-pressure mercury lamp made up of: an arc tube which includes a discharge space, mercury and xenon gas being sealed in the discharge space; and a pair of electrodes which are set facing each other in the discharge space of the arc tube.

With this construction, xenon gas emits light immediately after the lamp is started up, thereby considerably improving the light buildup time.

It is preferable that the amount of mercury per unit volume that is to be sealed in the discharge space is within a range of 0.12 mg/mm$^3$ to 0.35 mg/mm$^3$. Also, the pressure of the xenon gas in the discharge space is preferably within a range of $2.0\times10^5$ Pa to $2.0\times10^6$ Pa.

At least one of chlorine, bromine, and iodine is sealed as a halogen substance into the discharge space of the arc tube. Thus, by means of the halogen cycle, occurrence of blackening on the inner wall of the arc tube can be reduced, so that the life of the lamp is increased.

It is preferable that the total amount of the halogen substance per unit of volume that is to be sealed in the discharge space is within a range of $1.0\times10^{-7}$ $\mu$mol/mm$^3$ to $1.0\times10^{-2}$ $\mu$mol/mm$^3$.

The object of the present invention can be also achieved by a high-intensity discharge lamp made up of: an arc tube which includes a discharge space, at least a part of a wall of the arc tube being transparent and two kinds of light emitting materials which are respectively in a liquid state and a vapor state at a room temperature being sealed in the discharge space; and a pair of electrodes, each of which passes through the wall of the arc tube and is inserted into the discharge space.

With this construction, the light emitting material in a vapor state first emits light immediately after the lamp is started up, and then the light emitting material in a liquid state is gradually vaporized to emit light as a temperature in the discharge space of the arc tube rises. Consequently, the light buildup time can be considerably reduced as compared with a case where only a light emitting material in a liquid state is sealed in the arc tube.

The object of the present invention can be also achieved by a high-intensity discharge lamp made up of: an arc tube which includes a discharge space, at least a part of a wall of the arc tube being transparent and a first light emitting material and a second light emitting material whose light buildup time is shorter than the first light emitting material being sealed in the discharge space; and a pair of electrodes, each of which passes through the wall of the arc tube and is inserted into the discharge space.

With this construction, the second light emitting material with a shorter light buildup time emits light immediately after the lamp is started up, and the first light emitting material gradually emits light. Here, as the first light emitting material, it is preferred to use a material having an excellent luminous efficiency and an advantage contributing to an increase in the life of the lamp. Since the second light emitting material is sealed in addition to the first light emitting material, the light buildup time can be reduced as compared with a case where only the first light emitting material is used. At the same time, the excellent high-intensity discharge lamp taking full advantage of the first light emitting material can be realized.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF PREFERRED EMBODIMENTS

The following is a description of embodiments of the present invention, with reference to the drawings.

First Embodiment

Figure 1:
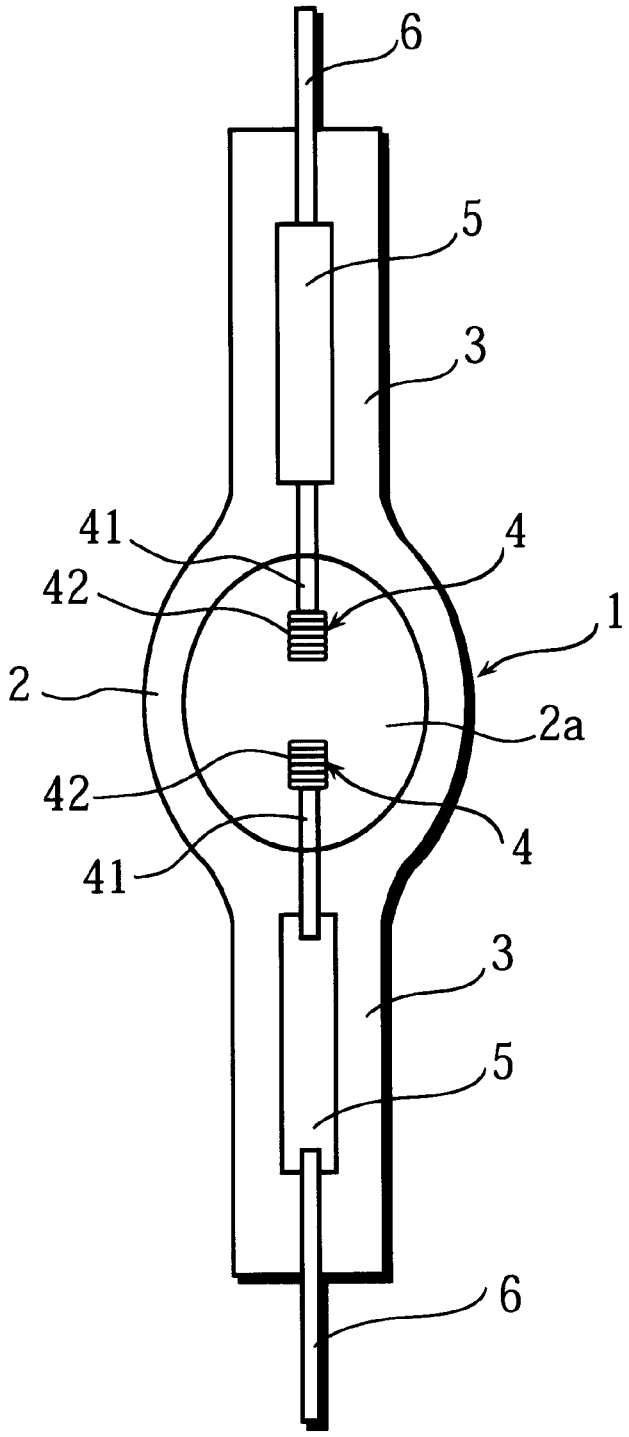
FIG. 1 is a front view of a high-pressure mercury lamp of a first embodiment of the present invention.

FIG. 1 is a front view of a high-pressure mercury lamp 1 of the first embodiment of the present invention. As shown in this figure, the high-pressure mercury lamp 1 is composed of a tube 2 with a pair of sealing parts 3, a pair of electrodes 4, and so on. The tube 2 is made of quartz glass, with its middle part in the direction of the length being spheroid. The maximum internal diameter of the central part of the tube 2 is 7.0 mm, the capacity of the tube 2 is 240 $mm^3$, and the wall thickness is 2.5 mm. A sealing part 3 is provided at both ends of the tube 2.

In a discharge space 2*a* of the tube 2, 36 mg of mercury (about 0.16 $mg/mm^3$), $9.0\times10^{-5}$ $\mu mol/mm^3$ of bromine (Br) as a halogen substance, and an appropriate amount of xenon gas (which will be described later) are sealed.

A pair of electrodes 4 is provided in the discharge space 2 a of the tube 2. Each electrode 4 has an electrode rod 41 and an electrode coil 42 provided at the tip of the electrode rod 41, and is connected to an external lead wire 6 via a metal foil 5 made of molybdenum. The electrode rod 41 is 0.4 mm in diameter and made of tungsten whose content of potassium oxide is 5 ppm or less. The electrode coil 42 is made of tungsten wire which is 0.25 mm in diameter and whose content of potassium oxide is 5 ppm or less. The distance between these electrodes 4, namely the arc length, is 1.55 mm.

Figure 2:
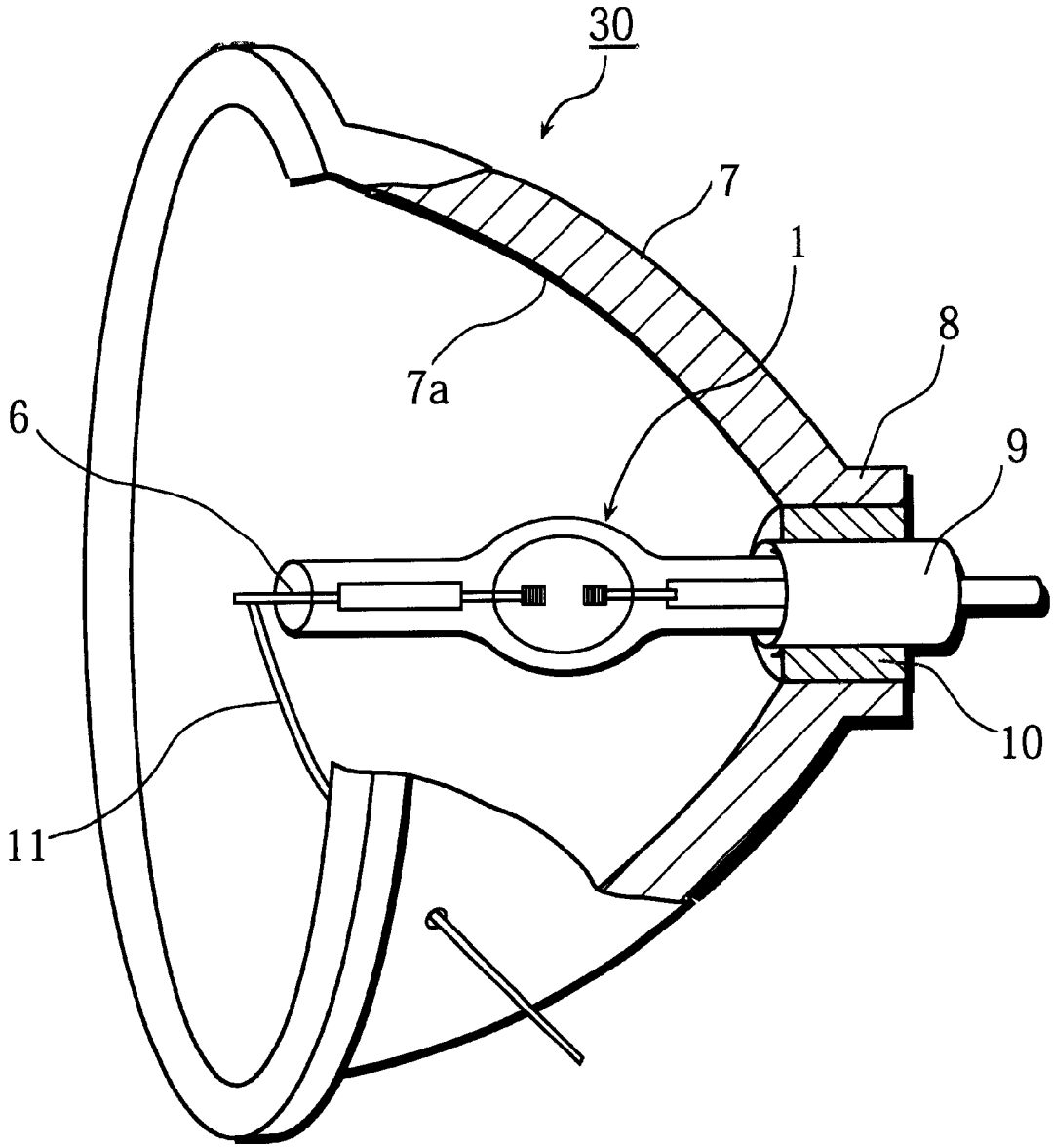
FIG. 2 is a perspective view, partially broken away, of an illumination device using the high-pressure mercury lamp.

FIG. 2 is a perspective view, partially broken away, of an illumination device 30 which is composed of the high-pressure mercury lamp 1 and a reflecting mirror 7.

As shown in FIG. 2, the reflecting mirror 7 is mounted on one end of the high-pressure mercury lamp 1. To be more specific, the high-pressure mercury lamp 1 is set inside the reflecting mirror 7 so that the arc axis of the high-pressure mercury lamp 1 lies in the optical axis of the reflecting mirror 7. The reflecting mirror 7 is made of ceramic and formed in the shape of an infundibular. The inner surface of the reflecting mirror 7 is paraboloid, and titanium oxide-silicon oxide is evaporated onto the inner surface so as to form a reflecting surface 7*a*.

A light projecting part, i.e. an opening of the reflecting mirror 7, is about 70 mm in diameter. The reflecting mirror 7 has a supporting tube 8 facing the opening. A base 9 fitted at one end of the high-pressure mercury lamp 1 is inserted into and fixed to the supporting tube 8 via an insulating cement 10. As a result, the high-pressure mercury lamp 1 and the reflecting mirror 7 are set integral with each other.

One external lead wire 6 (not shown) is electrically connected to the base 9 while the other external wire 6 is connected to a power supplying wire 11. One end of the power supplying wire 11 passes through a hole drilled through the wall of the reflecting mirror 7 and is guided to outside.

Using the illumination device 30 constructed as described above, the following experiment was conducted. In the experiment, an alternating current (AC) power was connected between the base 9 and the power supplying wire 11. Also, the high-pressure mercury lamp 1 was lit up under about 75 V of lamp voltage, about 2.3 A of lamp current, and 175 W of lamp power.

For this experiment, high-pressure mercury lamps having 175 W of power were prepared, each pressure of xenon gas being changed. Five lamps were made for each variation in the pressure. The light buildup time, illumination, and a sign of tube breakage are checked for each illumination device employing the lamps thus prepared. The detection results are shown in Table 1 below.

TABLE 1

| | pressure of Xe (Pa) | light buildup time (sec) | illumination | breakage of tube | evaluation |
|---|---|---|---|---|---|
| example 1 | $2.0\times10^5$ | 120 | ○ | not found | ○ |
| example 2 | $5.0\times10^5$ | 60 | ○ | not found | ○ |
| example 3 | $7.5\times10^5$ | 35 | ○ | not found | ○ |
| example 4 | $1.0\times10^6$ | 25 | ○ | not found | ○ |
| example 5 | $2.0\times10^6$ | 18 | ○ | not found | ○ |
| comparative example 1 | $6.0\times10^4$ | 240 | ○ | not found | X |
| comparative example 2 | $1.0\times10^5$ | 180 | ○ | not found | X |
| comparative example 3 | $3.0\times10^6$ | 15 | X | found | X |

In the column corresponding to the illumination in Table 1, ○ indicates that all of the five lamps illuminated and X indicates that not all of the five lamps illuminated.

As understood from Table 1, the light buildup time was reduced by sealing xenon gas in the tube. The reason why the light buildup time could be reduced by xenon gas is explained as follows.

In the conventional high-pressure mercury lamp, only mercury is sealed as the light-emitting material. As such, a predetermined mercury vapor pressure in the discharge space is required to obtain the light flux that is to be generated in the stable state. However, almost entire mercury that has been sealed is in a liquid state at room temperature. Thus, it takes about 5 to 10 minutes in general before the predetermined mercury vapor pressure is reached and so the light flux attains 90% of its stable state.

Meanwhile, an appropriate amount of xenon gas is sealed in addition to mercury in the present invention. As a result, the sealed xenon gas is excited and emits light before the predetermined mercury vapor pressure is reached. The light emitted by the xenon gas improves the light flux in the initial illumination of the lamp, thereby reducing the light buildup time. Mercury emits light under lower excitation energy than xenon gas. Thus, as the amount of evaporation of the sealed mercury increases due to a rise in the internal temperature, the principal light emitting material gradually shifts from xenon gas to mercury vapor. Then, the light flux caused by the sealed xenon gas gradually shrinks.

Note that light emitted by xenon gas is close to sunlight and is also close to an emission spectrum of mercury. Therefore, when the principal light emitting material shifts from xenon gas to mercury vapor, there would be no particular visual difference in the color of illumination.

In general, there is no practical problem in using the high-pressure mercury lamp in an image display apparatus as long as the light buildup time of the high-pressure mercury lamp is 120 seconds or less. Accordingly, it is preferred to set the pressure of xenon gas at $2.0\times10^5$ Pa or higher.

Meanwhile, as seen from the result obtained for the comparative example 3 shown in Table 1, when the pressure was set at $3.0\times10^6$ Pa, not all of the high-pressure mercury lamps illuminated and breakages of the tubes were found. Not all of the lamps illuminated due to a deteriorated start-up, which was caused by the high pressure of xenon gas. The breakage occurred since the tubes could not withstand the high pressure. Thus, it is desirable to set the pressure at $2.0\times10^6$ Pa or lower.

Subsequently, high-pressure mercury lamps were prepared, each restriking voltage being changed. Here, the restriking voltage is detected within several seconds to two minutes after the start-up of the lamp. A level of blackening occurring to the wall of the tube 2 was examined for each illumination device employing these high-pressure mercury lamps thus prepared, after 100 hours had elapsed since the lamp was lit up.

As a result, blackening did not occur to the tubes 2 of the lamps whose restriking voltages were 20 V or lower while it occurred to the tubes 2 of the lamps whose restriking voltages were 25 V or higher. Accordingly, it is desirable to set the restriking voltage at 20 V or lower to prevent blackening.

Figure 3:
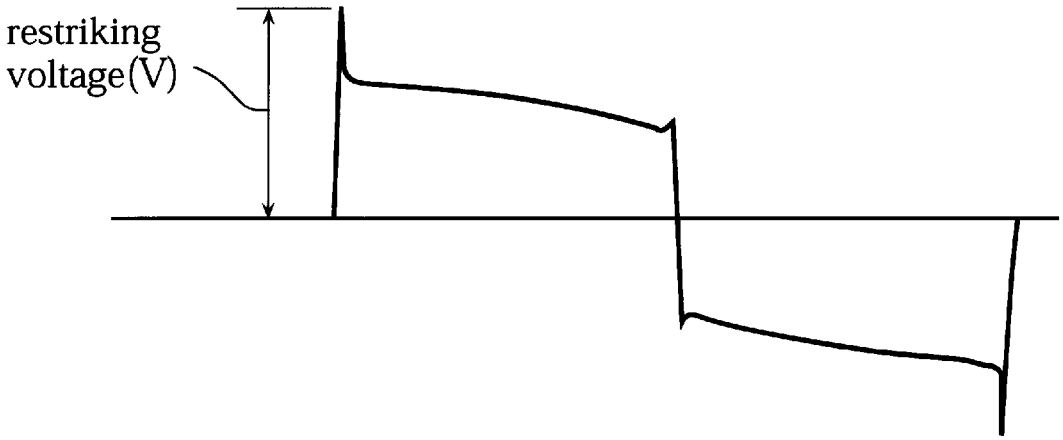
FIG. 3 shows a restriking voltage developed immediately after the high-pressure mercury lamp is lit up.

Note that the restriking voltage refers to a peak value of the voltage detected immediately after the lamp is lit up (within several seconds to two minutes after the start-up of the lamp) as shown in FIG. 3. As is known, the restriking voltage increases as impure gas, such as moisture and hydrogen gas, included in the tube increases. Therefore, it is possible to manufacture high-pressure mercury lamps whose restriking voltages are 20 V or lower by adjusting the amount of impure gas included in the tubes.

Next, an image display apparatus 100 using the illumination device 30 is described.

Figure 4:
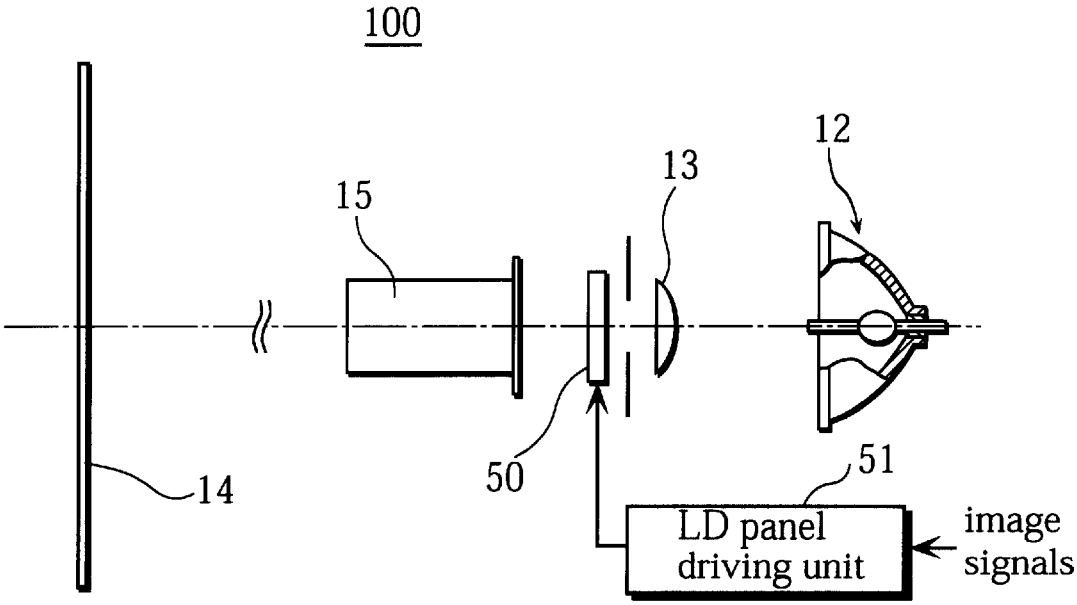
FIG. 4 is a view helping explain the construction of an image display apparatus that uses the illumination device.

FIG. 4 is a schematic view helping explain the construction of the image display apparatus 100. As shown in this figure, the image display apparatus 100 is composed of a light source unit 12 including the illumination device 30, a condensing lens 13, a liquid crystal (LC) panel 50, an LC panel driving unit 51, and a projection lens system 15.

The condensing lens 13 condenses light emitted by the light source unit 12. The LC panel 50 is a transmission-type panel used for displaying images. The LC panel driving unit 51 drives the LC panel 50 in accordance with inputted image signals, so that the LC panel 50 displays the images. The projection.lens system 15 projects light beams passing through the LC panel 50 onto the screen 14.

The following experiment was conducted using the image display apparatus 100. For the experiment, electrodes were prepared, each content of potassium oxide in the electrodes being changed. In this experiment, each high-pressure mercury lamp having 175 W of lamp power that employed these electrodes was used as the light source unit 12 of the image display apparatus 100. Then, the illuminance maintenance factor (%) of, the screen 14 was detected after 100 hours had elapsed since the light source unit 12 was lit up. The detection results are shown in Table 2 below. It should be noted here that the LC panel 50 was removed in this experiment in order to obtain accurate data for illuminance only. Also, note that each tube 2 used in the experiment was made of quartz glass whose content of OH group is 1 ppm.

TABLE 2

| | $K_2O$ content (ppm). | illuminance maintenance factor (%) | evaluation |
|---|---|---|---|
| example 6 | 5 | 96 | ○ |
| example 7 | 8 | 92 | ○ |
| example 8 | 12 | 90 | ○ |
| comparative example 4 | 15 | 84 | X |
| comparative example 5 | 75 | 74 | X |

As clearly understood from Table 2, the illuminance maintenance factor decreased as the content of potassium oxide included in an electrode increased.

The illuminance maintenance factor decreased in this way since blackening had occurred to the inner wall of the tube 2. This is to say, the level of blackening increased as the content of potassium oxide in an electrode increased. An occurrence of blackening is ascribable to that potassium out of potassium oxide included in an electrode is more likely to combine with bromine than tungsten is. This combination of potassium with bromine significantly interferes with a well-known halogen cycle, and fly-offs of tungsten of the electrode adhere to the inner wall of the tube 2, causing the blackening.

In general, there is no practical problem if the illuminance maintenance factor is 90% or more. Therefore, it is preferred to define the content of potassium oxide in an electrode 4 at 12 ppm or less. In reality, the less the content of potassium oxide, the better. Thus, it is preferable to set it at 0 ppm.

The content of potassium oxide can be reduced by repeating the tungsten refining process. Also, the content of potassium oxide in the refined tungsten can be easily measured according to the atomic absorption method.

Next, high-pressure mercury lamps were prepared, each moisture content in quartz glass that is the major constituent of the tube 2 of each high-pressure mercury lamp being changed. Using these lamps, the following experiment was conducted. Each of the lamps had 175 W of lamp power and was used as the light source unit 12 of the image display apparatus 100. In the experiment, the illuminance maintenance factor (%) of the screen 14 was detected after 100 hours had elapsed since the light source unit 12 was lit up. The detection results are shown in Table 3 below. It should be noted here that tungsten whose content of potassium oxide was 5 ppm or less was used as the electrode 4.

TABLE 3

| | OH group content (ppm) | illuminance maintenance factor (%) | evaluation |
|---|---|---|---|
| example 9 | 1 | 98 | ○ |
| example 10 | 3 | 90 | ○ |
| comparative example 6 | 6 | 88 | X |
| comparative example 7 | 15 | 79 | X |

As apparent from Table 3, the illuminance maintenance factor decreased as the content of OH group included in quartz glass increased.

The illuminance maintenance factor decreased in this way since blackening had occurred to the inner wall of the tube 2. This is to say, the level of blackening increased as the content of OH group included in quartz glass increased. An occurrence of blackening is ascribable to that OH group is diffused and enters into the discharge space 2*a* of the tube 2 while the lamp is being lit up. The OH group entered into the discharge space 2*a* combines with bromine. This also significantly interferes with the well-known halogen cycle, and fly-offs of tungsten included in the electrode adhere to the inner wall of the tube 2, causing the blackening.

In general, there is no practical problem if the illuminance maintenance factor is 90% or more. Therefore, it is preferred to define the content of OH group in quartz glass at 3 ppm or less. In reality, the less the content of OH group, the better. Thus, it is preferable to set it at 0 ppm.

Quartz glass having less content of OH group can be formed according to the melt-vacuum method. Also, the content of OH group included in quartz glass can be easily measured using the Fourier transform infrared spectrophotometer (FT-IR).

In the present embodiment, an explanation has been given in a case where a high-pressure mercury lamp having 175 W of lamp power is used. However, the high-pressure mercury lamp of the present invention is not limited to this. For example, the present invention may be applied to a high-pressure mercury lamp having a lamp power less than 175 W. Alternatively, it may be applied to a high-pressure mercury lamp having a lamp power more than 175 W, for example 200 W.

Second Embodiment

The following is a description of a high-pressure mercury lamp 60 of the second embodiment.

Figure 5:
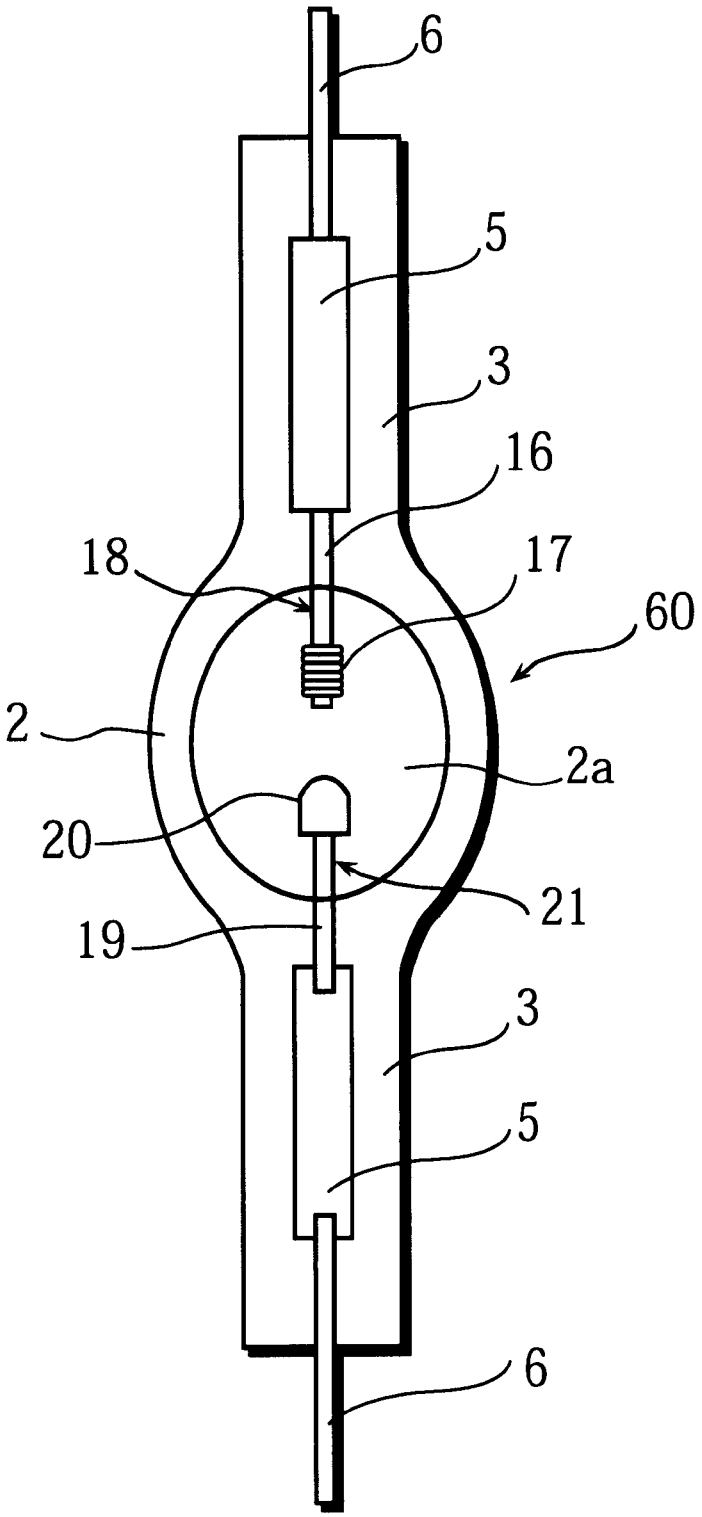
FIG. 5 is a front view of a high-pressure mercury lamp used in a second embodiment of the present invention.

FIG. 5 is a front view of the high-pressure mercury lamp 60. The high-pressure mercury lamp 60 is a direct-current (DC) type lamp. As shown in FIG. 5, a cathode 18 and an anode 21 are provided in a discharge space 2*a*. The cathode 18 includes an electrode coil 17 and an electrode rod 16, the electrode coil 17 being wound around the end of the electrode rod 16 leaving 0.75 mm at the tip of the rod 16 uncovered. The anode 21 includes an electrode tip 20 and an electrode embedding rod 19, the electrode tip 20 being set on the tip of the electrode embedding rod 19. The electrode embedding rod 19 is 0.4 mm in the outer diameter. The electrode tip 20 is made of tungsten whose content of potassium oxide is 5 ppm or less, and is 1.8 mm in the maximum outer diameter and 0.7 mm in the tip-end diameter. The high-pressure mercury lamp 60 is lit up through the application of a DC voltage between the cathode 18 and the anode 21. The high-pressure mercury lamp 60 has the same construction as the high-pressure mercury lamp 1 shown in FIG. 1 except for the above-mentioned electrode parts. As such, the same numerals shown in FIG. 1 and FIG. 5 have the same functions and, therefore, the explanation for these functions is emitted in the present embodiment.

The high-pressure mercury lamp 60 can achieve the same effects as is achieved by the high-pressure mercury lamp 1 of the first embodiment. Also, an illumination device using the high-pressure mercury lamp 60 and an image display apparatus using the illumination device can achieve the same effects as in the first embodiment.

As shown in FIG. 5, the anode 21 is larger than the cathode 18 in the volume. If the volume of the anode 21 is formed equal to or smaller than that of the cathode 18, electrons discharged from the cathode 18 would come into collision with the anode 21 while the lamp 60 is being lit up, causing an excessive rise in the temperature of the anode 21. This is undesired for the lamp. Meanwhile, the volume of the cathode 18 is formed smaller than that of the anode 21 in the present embodiment, so that the heat capacity of the cathode 18 becomes smaller. This prevents the temperature of the cathode 18 from falling below the temperature that maintains consistent discharge.

By forming the anode 21 larger than the cathode 18 in the volume, their temperatures remain almost the same during the lamp 60 is being lit up, thereby achieving the optimization of temperatures of the electrodes. The cathode 18 is provided with the electrode coil 17 having an excellent heat retaining property, which further improves the temperature balance with the anode 21.

The high-pressure mercury lamp 60 does not have to be lit up using a DC in the strict sense in the present embodiment, and therefore, a rectified AC or the like may be used.

Figure 6:
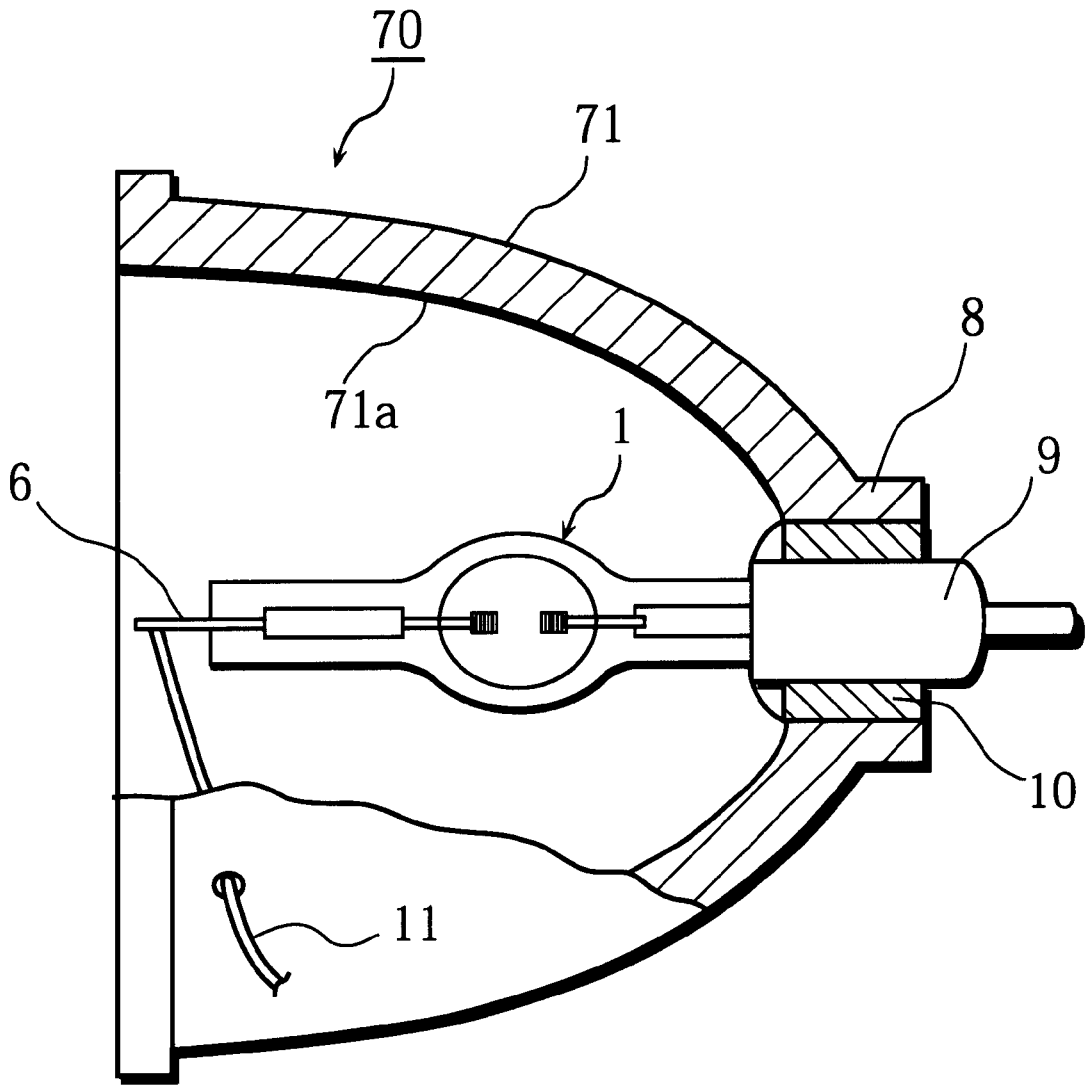
FIG. 6 is a front view, partially broken away, of a modification of a reflecting mirror of the illumination device.

In the illumination device 30 shown in FIG. 2, the reflecting mirror 7 having the paraboloid reflecting surface 7*a* is set integral with the high-pressure mercury lamp 1. However, as shown in FIG. 6, a reflecting mirror 71 having a curved reflecting surface 71*a* that is elliptic with its major axis corresponding to the optical axis of the mirror 71 may be set integral with the high-pressure mercury lamp 1 to form an illumination device 70. With this construction, the diameter of an opening of the reflecting mirror 71 can be formed smaller as compared with the reflecting mirror 7 shown in FIG. 2. This allows miniaturization of image display apparatuses or the like including the illumination device 70.

In the stated embodiments, explanations have been given only for the high-pressure mercury lamps. However, the same explanation can be given for high-intensity discharge lamps in which light-emitting materials other than mercury are sealed. More specifically, a first light-emitting material and a second light-emitting material whose light buildup time is shorter than the first material may be sealed in a discharge space of a tube. In general, the first material is in a liquid state at room temperature (around 25° C.) as is the case with mercury while the second material is in a vapor state at room temperature as is the case with xenon gas.

In a such high-intensity discharge lamp, the second light-emitting material emits light immediately after the start-up of the lamp and then the first light-emitting material gradually emits light. Here, as the first material, it is preferred to use a material having an excellent luminous efficiency and an advantage contributing to an increase in the life of the lamp. By means of the second material, the light buildup time can be reduced as compared with a case where only the first material is used. At the same time, the excellent high-intensity discharge lamp taking full advantage of the first material can be realized.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A high-pressure mercury lamp comprising:

an arc tube which includes a discharge space;

means for providing a visually indistinguishable color of illumination of emitted light between a start-up transition period and a steady state condition including a quantity of liquid mercury and xenon gas in the arc tube to enable an initial emission of light from a primary excitation of the xenon gas during start-up to a primary excitation of mercury vapor during the steady state condition; and a pair of electrodes which are set facing each other in the discharge space of the arc tube, where light emitted during a transition period is visually indistinguishable from light emitted during a steady state condition.

2. The high-pressure mercury lamp of claim 1, wherein an amount of mercury per unit volume that is to be sealed in the discharge space is within a range of 0.12 $mg/mm^3$ to 0.35 $mg/mm^3$.

3. The high-pressure mercury lamp of claim 1, a pressure of the xenon gas in the discharge space is within a range of $2.0\times10^5$ Pa to $2.0\times10^6$ Pa.

4. The high-pressure mercury lamp of claim 1, wherein at least one of chlorine, bromine, and iodine is sealed as a halogen substance into the discharge space of the arc tube.

5. The high-pressure mercury lamp of claim 4, wherein a total amount of the halogen substance per unit of volume that is to be sealed in the discharge space is within a range of $1.0\times10^{-7}$ $\mu mol/mm^3$ to $1.0\times10^{-2}$ $\mu mol/mm^3$.

6. The high-pressure mercury lamp of claim 1, wherein a major constituent of material used for manufacturing each of the pair of electrodes is tungsten whose content of potassium oxide is 12 ppm or less.

7. The high-pressure mercury lamp of claim 1, wherein the arc tube is made of quartz glass whose content of moisture (OH group) is 3 ppm or less.

8. The high-pressure mercury lamp of claim 1, wherein one of the pair of electrodes is an anode while the other one of the pair of electrodes is a cathode, a volume of the anode being larger than a volume of the cathode.

9. An illumination device composed of a high-pressure mercury lamp and a reflecting mirror, wherein the high-pressure mercury lamp includes:

an arc tube which includes a discharge space;

means for providing a visually indistinguishable color of illumination of emitted light between a start-up transition period and a steady state condition including a quantity of liquid mercury and xenon gas in the arc tube to enable an initial emission of light from a primary excitation of the xenon gas during start-up to a primary excitation of mercury vapor during the steady state condition; and a pair of electrodes which are set facing each other in the discharge space of the arc tube, where light emitted during a transition period is visually indistinguishable from light emitted during a steady state condition, and wherein the reflecting mirror includes a reflecting surface that is a surface of revolution being gradually widened in diameter in a light emitting direction, and is mounted on one end of the high-pressure mercury lamp so that an optical axis of the reflecting mirror lies in an arc axis of the high-pressure mercury lamp.

10. The illumination device of claim 9, wherein the surface of revolution is paraboloid.

11. The illumination device of claim 9, wherein the surface of revolution is elliptical with its major axis corresponding to the optical axis.

* * * * *